US005842103A

United States Patent [19]

Swift

[11] Patent Number: 5,842,103

[45] Date of Patent: Nov. 24, 1998

[54] CLEANING DEVICE WITH IMPROVED DETONING EFFICIENCY

[75] Inventor: Joseph A. Swift, Ontario, N.Y.

[73] Assignee: Xerox Corporation, Stamford, Conn.

[21] Appl. No.: 782,160

[22] Filed: Jan. 13, 1997

[51] Int. Cl.[6] ..... G03G 21/00

[52] U.S. Cl. ..... 399/353; 15/1.51

[58] Field of Search ..... 399/353, 354, 399/355; 428/403, 407; 15/1.51

[56] References Cited

U.S. PATENT DOCUMENTS 4,319,831 3/1982 Matsui et al. .

4,469,435 9/1984 Nosaki et al. ..... 399/148

4,835,807 6/1989 Swift .

FOREIGN PATENT DOCUMENTS 6-138751 5/1994 Japan .

*Primary Examiner*—Joan H. Pendegrass

*Attorney, Agent, or Firm*—Oliff & Berridge, PLC

[57] ABSTRACT

A conductive fiber having at least one fiber forming material and conductive materials and coated with a polymer which reduces the surface energy of the fiber below an initial surface energy of the fiber is disclosed. The fibers are preferably used in an electrostatic cleaning device which removes residual toner from the surface of an imaging member. The coated conductive fibers significantly improve the detoning efficiency of cleaning devices incorporating the fibers.

20 Claims, No Drawings

CLEANING DEVICE WITH IMPROVED DETONING EFFICIENCY

BACKGROUND OF THE INVENTION

1. Field of the Invention

This invention relates to conductive fibers and a method of making conductive fibers used in electrostatic cleaning brushes for electrostatographic printing devices.

2. Discussion of Related Art

Electrostatic cleaning brushes are used in electrostatographic printing devices such as photocopiers, laser printers, facsimile machines or the like to remove residual toner from the surface of an imaging member of the device prior to the formation of a subsequent image on the imaging member. It is very important that the cleaning brush remove all residual toner without damaging the surface of the imaging member so that subsequent images developed with the imaging member remain high in quality and free of staining and fogging from residual toner.

Another important property of the cleaning brush is that it be able to detone efficiently, i.e., efficiently hand off residual toner collected from the imaging member surface to a detoning roll. If the brush does not detone efficiently, the life of the brush is greatly reduced as it can quickly become clogged with toner. Presently used brushes have a service life on the order of 1 to 2 million copies which is generally limited by loss of acceptable detoning or toner accumulation beyond an acceptable level within the brush. When the brush retains a large percentage of toner, not only is the ability of the brush to remove additional residual toner reduced, but the toner remaining in the brush can fuse to the brush fiber tips. The fused tip creates a harder surface contacting the imaging member, which can scratch the surface of the imaging member. Also, high concentrations of toner in the brush can redeposit on the photoreceptor and cause unacceptable copy quality.

Electrostatic cleaning brushes are conventionally formed of pile fabrics comprising antistatic or electrically conductive fibers. For example, U.S. Pat. No. 4,319,831 to Matsui et al. discloses conjugate (i.e., sheath/core or side-by-side) conductive fibers for use in a copy machine cleaning device. One portion of the conjugate fiber is conductive while the other portion is non-conductive. The conductive portions of the fiber are formed from a mixture of a suitable polymer and conductive materials.

In another example, U.S. Pat. No. 4,835,807 to Swift, incorporated herein by reference, discloses electroconductive fibers of nylon filamentary polymer substrate having finely divided electrically conductive particles of carbon black on the surface of the fiber of a cleaning brush for an electrostatographic reproducing apparatus. The conductive carbon black is present in sufficient quantity to render the electrical resistance of the film from about $1\times10^3$ ohms per centimeter to about $1\times10^9$ ohms per centimeter.

In another example, U.S. Pat. application No. 08/673,531 to Swift (Docket No. D/94733) entitled "Electrically Conductive Fibers" incorporated herein by reference, describes a miniature cleaning brush which comprises fine diameter electroconductive fibers having finely divided carbon black on the surface of a filamentary polymer substrate sufficient to render the fiber resistance within the range of $1\times10^3$ ohms per centimeter to about $1\times10^{12}$ Ω/cm where the fineness of the fibers is about 0.1 to about 11 denier.

Electrostatic cleaning brushes are typically made of fine diameter synthetic fibers, for example, nylon or acrylic, which have been rendered electroconductive by the addition of conductive particles, for example, carbon black, to the polymer used to make the fiber. Often, a spin finish is applied as a surface overcoating to these fibers to facilitate high speed textile processing such as plying and twisting of the monofilaments into yarn, typical operations performed before and during brush fabrication. One known spin finish is NS-19, a proprietary polyoxyethylene based material manufactured by BASF. Other known spin finishes include liquid or oil lubricants, for example, Stantex coning oil, a proprietary mineral oil based lubricant manufactured by the National Starch Company. However, poor detoning capabilities have been experienced when conductive fibers coated with such spin finishes are used in electrostatic cleaning brushes.

One possible way to slightly improve the detoning capabilities of such spin finish coated fibers is to clean the fibers of the finish prior to incorporation into a cleaning device. However, such cleaning of the fibers, for example by solvent scrubbing, has high cost and an environmental concern with solvent disposal. Furthermore, the improvement in detoning efficiency is slight compared to the cost involved. Thus, removal of the spin finishes is often not a viable option.

SUMMARY OF THE INVENTION

In an effort to improve the detoning efficiency of electrostatic cleaning brushes in a cost effective manner, the inventor undertook a study of conventional conductive fibers used in electrostatic cleaning brush applications. It was found that conventional conductive fibers used in such applications have high intrinsic surface energies, and that existing spin finishes coating such fibers either did not affect the intrinsic surface energy of the fiber or contributed to an increase in the surface energy of the fiber.

It is believed that the high surface energies of the conductive fibers used in electrostatic cleaning brushes adversely affects the detoning efficiency of such brushes. Further, the high surface energies are believed to contribute to higher friction forces between the brush and the imaging member, i.e., photoreceptor, surface. Toner has been observed to actually fuse to the tips of some of the conductive fibers, possibly due in part to heating of the toner due to friction. The ability of the cleaning brush to thereafter remove toner, i.e., clean, the surface of the imaging member is degraded. The ability to detone toner from the brush is also adversely affected. Importantly, the presence of fused toner on the fiber is known to adversely scratch the photoreceptor and thereby degrade its performance.

It is therefore an object of the present invention to obtain conductive fibers having sufficiently low surface energies to be suitable for use in electrostatic cleaning brushes. It is a further object of the present invention to develop a simple, integrated process for producing such low surface energy conductive fibers. It is yet a further object of the present invention to obtain an electrostatic cleaning brush high in detoning efficiency and low in brush to imaging member friction.

These and other objects are achieved in the present invention by coating conductive fibers with a coating that reduces the surface energy of the fiber. The coating material can be applied during normal fiber formation processing so that no additional equipment or post-processing is necessary in order to achieve conductive fibers having reduced surface energies. The conductive fibers having such reduced surface energies are preferably formed into a fabric for incorporation into an electrostatic cleaning device for use in an electrostatographic printing device.

DETAILED DESCRIPTION OF PREFERRED EMBODIMENTS

As the conductive fibers to be used in electrostatic cleaning devices, any conventional conductive fiber of any configuration may be suitably used. The fibers may be of any form such as single filament, a plurality of filaments, for example, plied and/or twisted filaments, or conjugate fibers such as sheath/core or side-by-side fibers.

The conductive fibers comprise at least a fiber forming polymer and conductive fillers. As the fiber forming polymer, any thermoplastic, thermosetting and/or solvent soluble polymers capable of being spun in the fiber formation method are suitable. As examples, mention is made of polyamides such as Nylon-6, Nylon-11, Nylon-12, Nylon-66, Nylon-610, Nylon-612, etc., polyesters such as polyethylene terephthalate, polybutylene terephthalate, etc., polyolefins such as polyethylene, polypropylene, etc., polyethers such as polymethylene oxide, polyethylene oxide, polybutylene oxide, etc., vinyl polymers such as polyvinyl chloride, polyvinylidene chloride, etc., polycarbonates, polystyrene, copolymers and mixtures of the foregoing polymers. Solvent soluble polymers include acrylic polymers such as acrylonitrile, cellulose polymers such as cellulose and cellulose acetate, vinyl alcohol polymers, such as polyvinyl alcohol, and polyurethane, copolymers and mixtures of the foregoing polymers.

To the fiber forming polymer may be added various conventional additives such as, for example, delusterants, pigments, dyes, stabilizers, lubricants such as waxes, polyethylenes, silicone compounds and fluorine compounds, and anti-static agents such as polyalkylene and various surfactants.

As the conductive filler, very fine carbon black is preferred, although any suitable conductive fillers such as metal particles, metal oxide particles, or conductive organic materials may also be suitably used. The filler preferably has a fine diameter on the order of, for example, less than 20 microns, preferably less than 5 microns and most preferably less than 1 micron. Of course, the filler particles may align in mutual contact to form long conducting chains in the fiber. For the fiber to possess sufficient conductivity, the conductive filler is contained in the fiber in an amount ranging from, for example, 1 to 80% by weight of the fiber, preferably 2 to 50% by weight of the fiber. However, higher localized concentrations of, for example, greater than 10%, are generally required for sufficient conductivity, and the local concentration within the fiber must be above the electrical perculation threshold level for conductivity.

Conductive fibers are typically formed by spinning, drawing and drying and/or solidifying the conductive fiber. The fiber forming composition, comprising at least the fiber forming polymer and conductive filler, may be spun in any conventional manner. As is known in the art, dry spinning is conducted by dissolving the fiber forming composition in an appropriate solvent such as N,N-dimethylformamide or N,N-dimethylacetamide, and passing the solution through an orifice or spinneret into an evaporative gas atmosphere, for example nitrogen, in which much of the solvent is evaporated. Wet spinning is conducted by dissolving the fiber forming composition in an appropriate solvent and passing the solution through an orifice or spinneret into an aqueous coagulation bath. Melt spinning is conducted by applying high pressure to the fiber forming composition, which is heated to the melting point, thereby forcing an extrudate through an orifice of predetermined shape. Conjugate conductive fibers can be made in any known manner.

Following formation, the fibers are then typically drawn to increase fiber orientation and length and to reduce the outer diameter. A drawing ratio on the order of between 1.1 and 10, for example, is suitable.

The fibers are then dried to remove remaining solvent, for example by heating and/or otherwise solidified, for example by cooling the fiber to room temperature.

When the conductive fibers are to be used in an electrostatic cleaning device, the conductive fibers preferably have a fine diameter, for example, of between 10 and 50 microns, more preferably between 20 and 40 microns. The conductive fibers must have a fineness that will not scratch the surface of an imaging member such as a photoreceptor when the electrostatic cleaning device contacts the imaging member surface. In general, a fineness of less than 300 denier, more preferably less than 30 denier, is suitable.

For use in electrostatic cleaning devices, the resistance of the conductive fibers should preferably be not more than $10^{17}$ Ω/cm, and is more preferably less than $10^{13}$ Ω/cm and greater than $10^{2}$ Ω/cm, and is most preferably between $10^{3}$ to $10^{10}$ Ω/cm. In general, the lower the electric resistance of the fiber, the more efficiently the fiber's bias is able to exist at the fiber's tip which creates the cleaning field relative to the photoreceptor surface and the detoning field(s) relative to the detoning roll(s), and thereby the higher the ability the fiber has to remove toner from the surface of the imaging member and pass that toner onto the detoner roll. However, the resistance should not be so low as to create generalized shorting of the entire brush upon incidental contact with a ground.

Conventional conductive fibers for use in electrostatic cleaning devices are typically formed in an integrated process comprising spinning, drawing, plying (i.e., combining two or more filaments), coating the fiber with a spin finish, drying, and twisting the fiber. The spin finish is added as a lubrication aid to enable increased efficiency in the fiber and fabric fabrication processes. As discussed above, conventional spin finishes such as NS-19 and Stantex coning oil either do not affect or act to increase the surface energy of the fiber.

The conductive fibers discussed above, for example fine diameter nylon or acrylic fiber forming polymers containing fine carbon black, whether or not coated with a spin finish, typically have high initial or intrinsic surface energies of, for example, between 30 and 60 dynes/cm. The inventor has discovered a direct correlation between the detoning efficiency of an electrostatic cleaning device and the surface energy of the conductive fibers used in the electrostatic cleaning device. The lower the surface energy of fibers in a cleaning device, the better the detoning efficiency of the cleaning device.

When conventional high surface energy fibers are used in electrostatic cleaning devices, the electrostatic cleaning device adequately removes residual toner from the surface of the imaging member. However, the cleaning device exhibits a poor ability to detone, i.e., release the toner particles collected by the fibers of the cleaning device to a toner collection, or detoning, roll.

High detoning efficiency is important not only to the service life of the cleaning device, but also to the ability of the cleaning device to continue to remove residual toner from the surface of the imaging member. The poorer the ability of the cleaning device to detone, the greater the accumulation of toner particles in the cleaning device, which in turn reduces the ability of the cleaning device to subsequently remove residual toner from the surface of the imaging member.

Further, the high surface energies of the conductive fibers contributes to a high cleaning device to imaging member friction. The higher friction negatively impacts the motion of the imaging member, which may result in offset or blurred images being developed. Further, the higher friction creates heat in the region where the cleaning device contacts the imaging member surface, which heat can fuse residual toner to the fibers of the cleaning device. While fusing of toner to the fibers of the cleaning device can reduce the ability of the cleaning device to both remove residual toner from the surface of the imaging member and detone, scratching of the surface is a substantial problem.

To alleviate and eliminate these problems associated with the high surface energy of the conductive fibers, the conductive fibers are coated with a polymer coating that reduces the surface energy of the conductive fibers. The coating preferably forms a uniform and durable coating on the outer surface of the fiber. Further coatings on the surface of the surface energy reducing coating may be added, so long as the additional coatings do not act to increase the surface energy of the fiber. The coating may be applied over conventional spin finishes, thus alleviating the need to scrub the fibers prior to incorporation into a cleaning device.

The coating should have a thickness sufficient to reduce the surface energy of the fiber and be durable, i.e., lasting the life of the brush. For example, the surface energy reducing coating preferably has a thickness of from 0.001 to 5 microns, more preferably between 0.01 and 0.5 micron. To achieve such thicknesses, typical coating weights preferably range from 0.01 to 10% by weight of the fiber, more preferably from 0.1 to 2% by weight.

The coating of the invention acts to reduce the initial or intrinsic surface energy of the conductive fiber. Preferably, following coating with the surface energy reducing coating, the conductive fiber has a surface energy less than 30 dynes/cm, preferably less than 20 dynes/cm, more preferably less than 15 dynes/cm.

By coating the conductive fibers with a surface energy reducing coating, an electrostatic cleaning device using such conductive fibers exhibits very low fiber to imaging member friction and very high detoning efficiency. The detoning efficiency of the cleaning device incorporating such fibers is over 70%, preferably over 80%, and more preferably over 90%, and most preferably 98% or greater. Such electrostatic cleaning devices have longer service lives, for example on the order of 2 to 10 million copies, exhibit excellent ability to remove toner from the surface of an imaging member, and result in no staining, fogging, offset or blurring of images subsequently developed using the imaging member. Another benefit of the surface energy reducing coating is that the conductive fibers are more durable, and thus have a longer life, than conductive fibers not coated with the coating.

As the coating, any polymeric material capable of reducing the surface energy of the conductive fibers is suitable. As examples, primarily aliphatic polymers containing silane or fluoro functional groups are suitable. The polymer may be cross-linkable. Preferred polymers include silicone polymers, fluorocarbon polymers, and mixtures thereof. As fluorocarbons, those with a high percentage of $CF_3$ constituent groups generally yield fibers with the lowest surface energies.

Examples of commercially available products that may be used to coat the fibers include liquid and solid coatings, McLube 1700 and McLube 1711 fluorocarbons made by McGee Industries, MS122N TFE Teflon and MS460/22 Silicone made by Miller Stephenson, Frekote 33H and Frekote 34 made by Freekote Inc., Essex Z Zinc Stearate and Essex G Silicone made by Essex, SLIDE lecithin made by Percy Harmes, FC-171, FC-430, FC-170-C, FC-431, FC129, FC-120, FC-725, FC-722 and FC-721 made by 3M, Vydar AR/IPA and Vydar ARW fluorocarbons made by DuPont, and DC200 350, DC HV-490 and DC20 Si silicones made by Dow Corning are acceptable. While liquid coatings may be used, solid film-forming and cross-linking polymers are preferred.

The coating may be applied at any suitable point during formation of the fiber or formation of the fabric for the electrostatic cleaning device. For example, it is possible to coat the formed fabric, for example, by dip coating, just prior to incorporation of the fabric into the electrostatic cleaning device. Conventionally formed conductive fibers may be coated with the surface energy reducing coating just prior to formation of the fibers into a fabric.

However, it is most preferable to coat the conductive monofilaments or fibers during the typical formation process. In this way, no additional equipment and/or post-processing of the conductive fibers is necessary. As discussed above, the typical conductive fiber formation process consists of spinning, drawing, plying, coating the conductive fiber with a spin finish, drying and twisting the fibers. To incorporate the coating of the surface energy reducing coating into this process, the spin finish coating step is preferably replaced by the step of coating the conductive monofilament or fiber with the surface energy reducing coating. Alternatively, the coating can be added before or after application of the conventional spin finish.

Of course, if the spin finish is replaced by the surface energy reducing coating, the surface energy reducing coating must be capable of adequately performing in the same manner as a conventional spin finish. In other words, the surface energy reducing coating must not only act to reduce the surface energy of the conductive fiber, it must also act as a spin finish, i.e., a lubricant, in the fiber and fabric formation processes. Thus, the surface energy reducing coating must be appropriately selected to perform this dual function. For example, polymers containing silane or fluoro functional groups may be mentioned as suitable candidates.

The coating may be coated onto the conductive fiber in any suitable conventional manner, such as roll, pad, immersion or dip coating. Preferably, the polymer coating is applied from a solution or dispersion formed using solvents that dissolve or emulsify the polymer and do not adversely affect the conductive fiber. Such solvents include, for example, water, methanol, isopropanol, ethanol, methyl ethyl ketone, toluene, acetone, and mixtures of the above. The solution typically contains between 0.1 and 30 percent by weight of the surface energy reducing coating material, more preferably between 0.5 and 10 percent by weight.

The surface energy reducing coating may also contain conventional additives such as anti-static agents, coloring agents, lubricants, etc., so long as the additives do not affect the surface energy reducing property of the coating. If the coating is to be applied during the fiber formation process, the additives must also not adversely affect the lubricating ability of the coating.

For incorporation into an electrostatic cleaning device, the conductive fibers are typically formed into a fabric, for example a pile fabric. The fabric is formed of a plurality of conductive fibers by any suitable method such as, for example, knitting or weaving. The coated conductive fibers preferably comprise between 40 and 100% by weight of the fibers forming the fabric for use in the electrostatic cleaning device. If additional non-conductive fibers are included in the fabric, such fibers are also most preferably coated with the surface energy reducing coating. The pile height of fabrics formed from the conductive fibers preferably ranges between 1 and 50 mm, more preferably between 3 and 15 mm.

The fabric is in association with the electrostatic cleaning device and forms that portion of the cleaning device that contacts the surface of the imaging member. The electrostatic cleaning device may have any suitable form such as, for example, a rotary brush, a rotary drum, or a belt.

In a conventional electrostatographic device such as a photocopier, a printer or a facsimile machine, a latent image is first formed on the surface of an imaging member such as an electrophotographic, or photoreceptor, drum. The imaging member is then rotated to a developing station where it is brought into contact with toner or developer in order to develop the image on the surface of the imaging member. The imaging member then rotates to a transfer station where the developed image is transferred either directly to an image receiving substrate such as paper or to a transfer member that transfers the developed image to an image receiving substrate. Following transfer of a developed image, the imaging member rotates to a cleaning station where it is cleaned by an electrostatic cleaning device that removes residual toner from the surface of the imaging member prior to such members rotation back to the latent image receiving station.

In the imaging member cleaning operation, a bias potential opposite in polarity to the residual toner on the imaging member is applied to the conductive fibers of the cleaning brush, thereby enabling residual toner to be picked up by the brush. The residual toner is then removed from the cleaning device, i.e., the device is detoned, by, for example, inducing a stronger bias between the device and a detoning roll, running the cleaning device against a flicker bar, vacuuming the cleaning device, or the like.

The invention will now be further described with reference to the following examples.

EXAMPLES

In the following examples, the surface energies of the fibers are measured using a Cahn DCA-322 Dynamic Contact Angle analyzer made by Cahn Instruments, Inc.

The detoning efficiency of the fibers in a Xerographic machine is approximated by measurement of the toner loss upon subjecting a toner containing test fiber to a force sufficient to dislodge some or all of the toner. This is accomplished either by direct force or centrifugal force. In the centrifugal force method, a length of the fiber is attached to a cork fitted into a test tube. The cork and fiber are weighed, the fiber is dipped in toner, re-weighed to determine the amount of toner picked up, inserted into a test tube, placed in a centrifuge machine and centrifuged at about 500 rpm for one minute to four minutes, and re-weighed. In the direct force method, a length of fiber is weighed, dipped in toner, re-weighed, flicked with a fingernail, and reweighed. A detoning efficiency of 80% indicates that 80% of the toner picked up by the fibers is removed from the fibers by imparting of the direct or centrifugal force.

Example 1

In the following example, the surface energy reducing coatings are applied to the fibers by immersing the fiber in a liquid solution of the coating material for a period of one to five minutes, until the fiber picks up a sufficient uniform coating of the material. The fiber is then air dried prior to evaluation.

Three nylon 6 fibers are coated with various commercially available agents. F-913 is a nylon 6 conjugate conductive fiber having a 1% NS-19 finish, is 17 denier and 42.5 microns in diameter. F-944R-40 is similar to F-913, but is 11 denier and 37 microns in diameter. F-944-60 is a non-conjugate nylon 6 conductive fiber with a 1% NS-19 coating and is 11 denier and 32 microns in diameter. Each of these fibers are manufactured by BASF.

The fibers are coated with coating materials as indicated in Table 1 below and all are evaluated for surface energy.

TABLE 1

| OVERCOAT APPLIED TO INDICATED FIBER | SURFACE ENERGY, dynes/cm |
|---|---|
| A (BASF F-913 - No overcoat) | 42.9 |
| B (BASF F-944R-40 - No overcoat) | 42.3 |
| C (BASF F-944R-60 - No overcoat) | 41.3 |
| UNELKO RAIN-X on C | 38.2 |
| Starett Ml on C | 37.5 |
| McGee Ind. McLube 1711 Fluorocarbon on C | 29.0 |
| McGee Industries McLube 1700 on C | 26.7 |
| Chestereon 983 on C | 24.4 |
| Miller Stephenson MS122N TFE Teflon on B | 23.9 |
| Freekote Inc. Frekote 34 on A | 22.9 |
| Percy Harmes SLIDE lecithin on A | 20.9 |
| Freekote Inc. Frekote 33H on A | 20.7 |
| Miller Stephenson MS460/22 Silicone on B | 20.5 |
| Essex Z Zinc Stearate on A | 19.2 |
| Essex G Silicone on A | 18.1 |
| Fluorocarbon 3M FC-171 on A | 35.1 |
| Fluorocarbon 3M FC-430 on A | 27.1 |
| Fluorocarbon 3M FC-170-C on A | 26.3 |
| Fluorocarbon 3M FC-431 on A | 25.3 |
| Fluorocarbon DuPont Vydax AR/IPA on A | 22.7 |
| Fluorocarbon DuPont Vydax ARW on A | 21.1 |
| Fluorocarbon 3M FC-129 on A | 15.3 |
| Fluorocarbon 3M FC-120 on A | 22.7 |
| Fluorocarbon 3M FC-725 on A | 10.2 |
| Fluorocarbon 3M FC-722 on A | 8.1 |
| Fluorocarbon 3M FC-721 on A | 8.0 |
| Silicone Dow Corning DC200 350 cs. on A | 38.0 |
| Silicone Dow Corning DC HV-490 on A | 25.9 |
| Silicone Dow Corning DC20 Si Release Coat on A | 19.0 |

The results indicate that the virgin fibers have high initial surface energies which are lowered by the surface energy reducing coatings.

Example 2

Additional coatings are applied to a F-944R-40 fiber, and such fibers are evaluated for both surface energy and detoning efficiency as indicated in Table 2 below. The results indicate that coatings which lower the surface energy below the initial surface energy value of the fiber significantly improve the detoning efficiency of the fiber.

The additional coating of NS-19 probably removes any contaminates from the fiber because it is an immersion and heating process. It also builds a thicker coating that probably covers the base fiber more completely than the original coating yielding a lower surface energy which is characteristic of the NS-19 material.

TABLE 2

| SURFACE COATING | SURFACE ENERGY, dynes/cm | DETONINING EFFICIENCY (% TONER REMOVED) Centrifuge Method | Direct Force Method |
|---|---|---|---|
| Fiber as received - No post treatment | 40.7 | 51.2* | 72.2* |
| Fiber washed w/water & acetone | 36.0 | 47.4 | 76.9* |
| NS-19*** | 34.2 | 60.5 | 62.5 |
| 3M FC-722 | 10.1 | 89.5 | 80.3 |
| 3M FC-725 | 10.5 | 79.1 | 85.0 |
| Dow Corning DC 20 Release Coat | 23.9 | 54.5 | 66.4 |
| Dow Corning DC HV-490 | 26.9 | 61.5 | 52.6 |
| DuPont TLF 8291 | 29.8 | 58.6 | 69.6 |
| DuPont Vydax AR/IPA | 30.2 | 58.7 | 65.2 |
| Unelco RAIN-X | 33.8 | 46.4 | 44.0 |
| Dow Corning DC200 350 cs. | 34.9 | 23.6** | 34.2** |
| 3M FC-171 | 35.5 | 53.1 | 60.0 |
| Stantex Oil | 35.9 | 6.8** | 5.7** |

*Values high due to premature loss of toner prior to testing.
**Values low due to adhesion of toner particles to oil.
***Additional coating applied over normal NS-19 finish; cured 10 min. @ 120° C.

Example 3

To evaluate the effect of an NS-19 finish coating on the above fibers, the fibers are washed with acetone to remove the finish coating and any surface contamination. The results are shown in Table 2, lines 1 to line 3 and Table 3, which indicate that there is some slight variation in the surface energy measurement's precision and that the fibers have lower surface energy following washing. This indicates that the initial NS-19 finish coating probably was very thin and did not fully reduce the surface energy of the fiber to the minimal level (34 dynes/cm) which was obtained with a thicker coating.

TABLE 3

| FIBER | SURFACE ENERGY, dynes/cm |
|---|---|
| BASF F-913, Unwashed | 43.2 |
| Same, washed | 39.6 |
| BASF F-944R-40, Unwashed | 41.7 |
| Same, washed | 38.4 |
| BASF F-944R-60, Unwashed | 39.4 |
| Same, washed | 37.7 |

While this invention has been described in conjunction with specific embodiments thereof, it is evident that many alternatives, modifications and variations will be apparent to those skilled in the art. Accordingly, the preferred embodiments as set forth herein are intended to be illustrative. Various changes may be made without departing from the spirit and scope of the invention as defined above.

What is claimed is:

1. An electrostatic cleaning device for use in electrostatographic printing devices, comprising a plurality of conductive fibers having an outer coating comprising a polymer containing silane or fluoro groups which reduces a surface energy of the conductive fibers below an initial surface energy of the conductive fibers prior to coating and the surface energy of the conductive fibers following coating is below 30 dynes/cm, the plurality of conductive fibers being in attached association with the electrostatic cleaning device.

2. The electrostatic cleaning device according to claim 1, wherein the device is in the form of a rotary brush, a drum or a belt.

3. The electrostatic cleaning device according to claim 1, wherein the plurality of coated conductive fibers comprise a pile fabric.

4. The electrostatic cleaning device according to claim 3, wherein the plurality of coated conductive fibers comprises between 50 and 100% by weight of the total fibers of the pile fabric.

5. The electrostatic cleaning device according to claim 3, wherein piles of the pile fabric have a height of between 1 and 50 mm.

6. The electrostatic cleaning device according to claim 1, wherein the coated conductive fibers have an individual fiber diameter of between 10 and 50 microns.

7. The electrostatic cleaning brush according to claim 1, wherein the outer coating is a silicone polymer, a fluorocarbon polymer, or mixtures thereof.

8. The electrostatic cleaning device according to claim 1, wherein the initial surface energy of the conductive fibers is between 30 and 60 dynes/cm.

9. An electrostatographic printing device, comprising an imaging member, an electrostatic latent image forming station for forming an electrostatic latent image on the imaging member, a developing station for developing the electrostatic latent image, a transfer station for transferring the developed image from the imaging member, and a cleaning station comprising the electrostatic cleaning device according to claim 1 for cleaning the imaging member following transfer of the developed image.

10. The electrostatic cleaning device according to claim 1, wherein the outer coating coats at least substantially all of an exterior surface of the conductive fibers.

11. The electrostatic cleaning device according to claim 1, wherein the coated conductive fibers exhibit a reduced fiber to imaging member friction.

12. A conductive fiber comprising at least one fiber forming material and conductive materials, the conductive fiber having an initial surface energy, and the conductive fiber having an outer coating comprising a polymer containing silane or fluoro groups which reduces the surface energy of the conductive fiber below the initial surface energy of the fiber and the surface energy of the conductive fibers following coating is below 30 dynes/cm.

13. The conductive fiber according to claim 12, wherein the outer coating is a silicone polymer, a fluorocarbon polymer, or mixtures thereof.

14. The conductive fiber according to claim 12, wherein the initial surface energy of the conductive fibers is between 30 and 60 dynes/cm.

15. A process for improving the detoning efficiency of an electrostatic cleaning device containing a plurality of conductive fibers, comprising coating at least the conductive fibers of the device with a polymer containing silane or fluoro groups which reduces a surface energy of the conductive fibers below an initial surface energy of the conductive fibers prior to the coating and the surface energy of the conductive fibers following coating is below 30 dynes/cm.

16. The process according to claim 15, wherein the coating is applied during or after formation of the conductive fibers.

17. The process according to claim 15, wherein the conductive fibers are formed by spinning, drawing, and optionally plying the conductive fibers prior to coating.

18. The process according to claim 15, wherein the conductive fibers are formed into a pile fabric.

19. The process according to claim 18, wherein the coating is applied to the conductive fibers after forming the conductive fibers into the pile fabric.

20. The process according to claim 15, wherein the initial surface energy of the conductive fibers prior to the coating is between 30 and 60 dynes/cm.

* * * * *